US005735422A

United States Patent [19]

Binter

[11] Patent Number: 5,735,422

[45] Date of Patent: Apr. 7, 1998

[54] MULTIPLE PART CONTAINER

[76] Inventor: Randolph K. Binter, 928 Fernwood, Moorestown, N.J. 08057

[21] Appl. No.: 825,960

[22] Filed: Apr. 4, 1997

Related U.S. Application Data

[63] Continuation of Ser. No. 605,462, Feb. 26, 1996, abandoned.

[51] Int. Cl.[6] ..... B65D 1/04; B65D 1/10; B65D 1/40

[52] U.S. Cl. ..... 220/4.21; 220/4.24; 220/4.27; 220/23.4; 220/523; 220/669; 215/6

[58] Field of Search ..... 220/4.21, 4.22, 220/4.24, 4.27, 4.23, 23.4, 4.01, 4.04, 4.05, 4.26, 28.83, 523; 215/6

[56] References Cited

U.S. PATENT DOCUMENTS

| | | | |
|---|---|---|---|
| 1,349,716 | 8/1920 | Elliot | 220/23.4 X |
| 3,994,408 | 11/1976 | Belitzky | 220/23.4 X |
| 4,126,239 | 11/1978 | Gehrig et al. | 220/4.23 X |
| 4,139,114 | 2/1979 | Long et al. | 220/4.27 X |
| 5,139,299 | 8/1992 | Smith | 220/23.4 X |
| 5,158,209 | 10/1992 | Reil et al. | 220/4.24 X |
| 5,316,159 | 5/1994 | Douglas et al. | 220/23.4 X |
| 5,356,040 | 10/1994 | Reggiani | 220/23.4 X |

*Primary Examiner*—Allan N. Shoap
*Assistant Examiner*—Niki M. Kopsidas
*Attorney, Agent, or Firm*—Woodcock Washburn Kurtz Mackiewicz & Norris LLP

[57] ABSTRACT

A molded thermoplastic multiple part container having a plurality of individual containers arranged about a central longitudinal axis to form fractional portions of the multiple part container and locking structure integral with the sidewalls of each individual container for locking together the individual containers about the central longitudinal axis to form a unitary multiple part container.

17 Claims, 4 Drawing Sheets

MULTIPLE PART CONTAINER

This is a continuation of application Ser. No. 605,462, filed Feb. 26, 1996 now abandoned.

FIELD OF THE INVENTION

This invention relates to a multiple part container particularly suited for packaging two separate products in one container.

BACKGROUND OF THE INVENTION

There are numerous chemical products that are adapted to be mixed together when used but are preferably packaged individually so that they remain separated until use. One example are epoxy activates. Another example is the packaging of a solid detergent composition such for example as described in U.S. Pat. No. 5,318,713—Binter. In that patent there is illustrated a multi-chambered container which includes a internal separator structure to separate the components of the detergent composition by the compartments according to chemical compatibility. Since the components of the detergent composition are used together, it is desirable that they be packaged in the same container. While this can be achieved with a multi-chambered container, it would be desirable if the individual chambers could be separated from each other and from the container so that the chambers could be filled individually and then the chambers reunited into a single container.

The present invention is directed to addressing these and other problems associated with packaging dissimilar products in the same container.

SUMMARY OF THE INVENTION

In accordance with the present invention there is provided a multiple part container having a central longitudinal axis. The multiple part container comprises a plurality of individual containers each having a mouth, sidewalls and a closed bottom to form fractional portions of the multiple part container. There is provided locking structure integral with the sidewalls of each individual container for locking together the individual containers forming the fractional portions about the central longitudinal axis to form a unitary multiple part container. The locking structure comprises cooperating male and female elements on the individual containers located within the periphery of the multiple part container. The locking structure also includes interlocking button structure on engaging sidewalls of the individual containers. A common top is provided for covering all of the mouths of the individual containers.

In one preferred form of the invention the multiple part container is cylindrical and the common top comprises a screw lid for the multiple part cylindrical container and the mouths of the individual containers are associated with screw threads for cooperation with the screw lid to aid in holding the fractional portions together about the central longitudinal axis.

For a more detailed understanding of the invention and for illustration of various forms thereof, reference is made to the accompanying drawings.

DESCRIPTION OF THE PREFERRED EMBODIMENT

Figure 1:
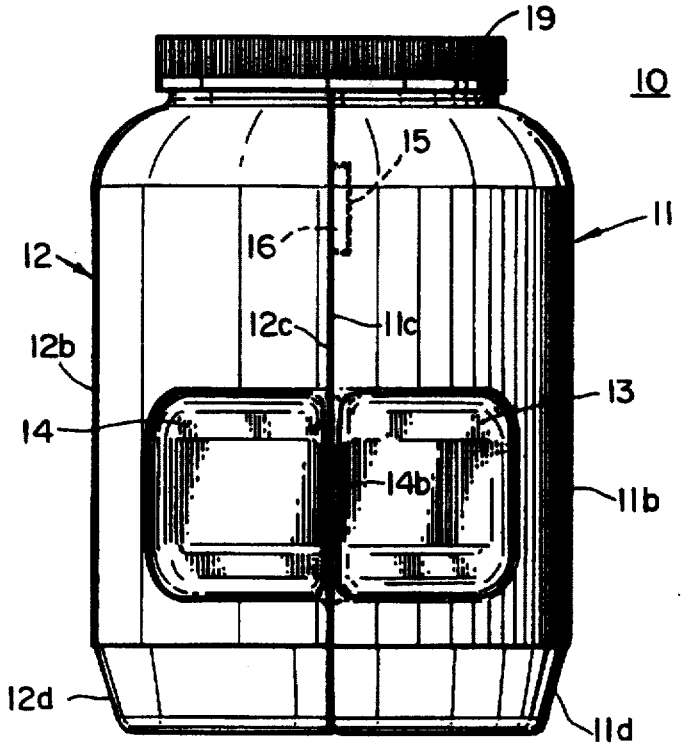
FIG. 1 is a front elevational view of a multiple part container embodying the present invention and shown in assembled form.
Figure 2:
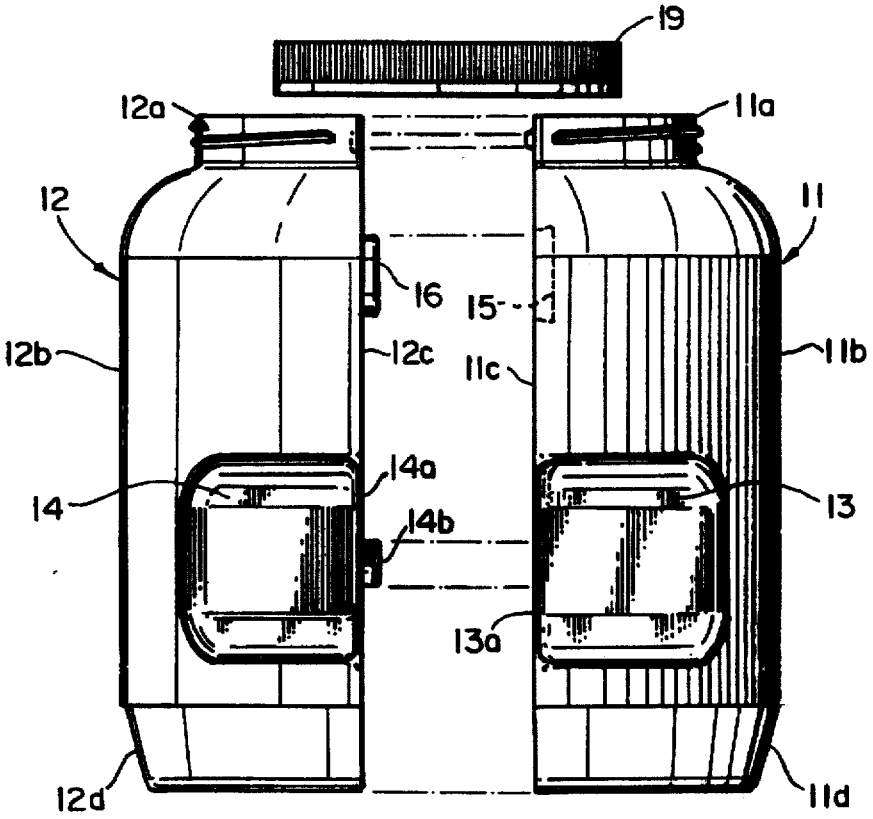
FIG. 2 is an exploded view of the multiple part container shown in FIG. 1.
Figure 3:
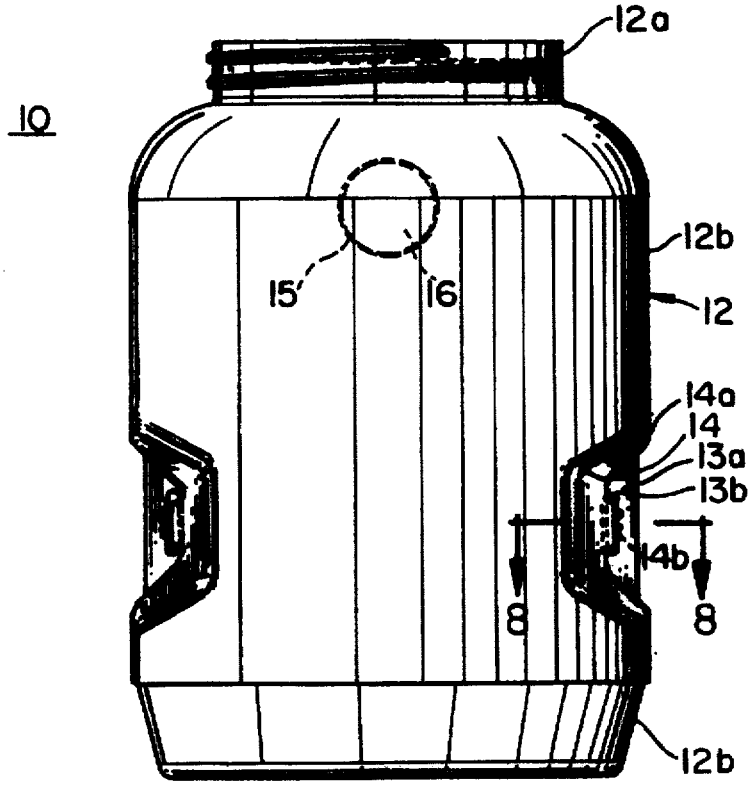
FIG. 3 is a side elevational view of the multiple part container shown in FIG. 1.
Figure 4:
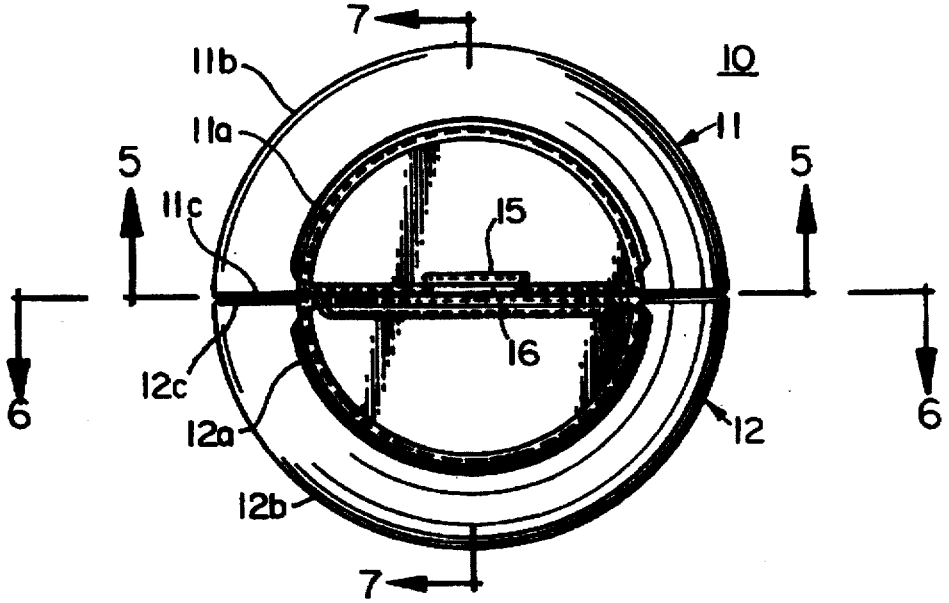
FIG. 4 is a top plan view of the multiple part container shown in FIG. 3.

The multiple part container of the present invention will be described in connection with the two part container illustrated in the drawings. Referring to FIGS. 1–6, it will be seen that the multiple part container 10 comprises two individual containers 11 and 12 which form fractional portions of the multiple part container 10. The multiple part container 10 is of cylindrical shape having a central longitudinal axis and each of the individual containers 11 and 12 are of semi-cylindrical shape. As may be seen in FIG. 2, the container 11 has a mouth **11*a*, a semi-cylindrical sidewall 11*b*, a flat sidewall 11*c* and a closed bottom 11*d*. The other semi-cylindrical container 12 has a mouth 12*a*, a semi-cylindrical sidewall 12*b*, a flat sidewall 12*c* and a closed bottom 12*d*. As may be seen in FIGS. 1–4, the individual containers 11 and 12** form fractional portions of the multiple part container and are arranged around the central longitudinal axis of the multiple part container to form a unitary multiple part container.

Figure 5:
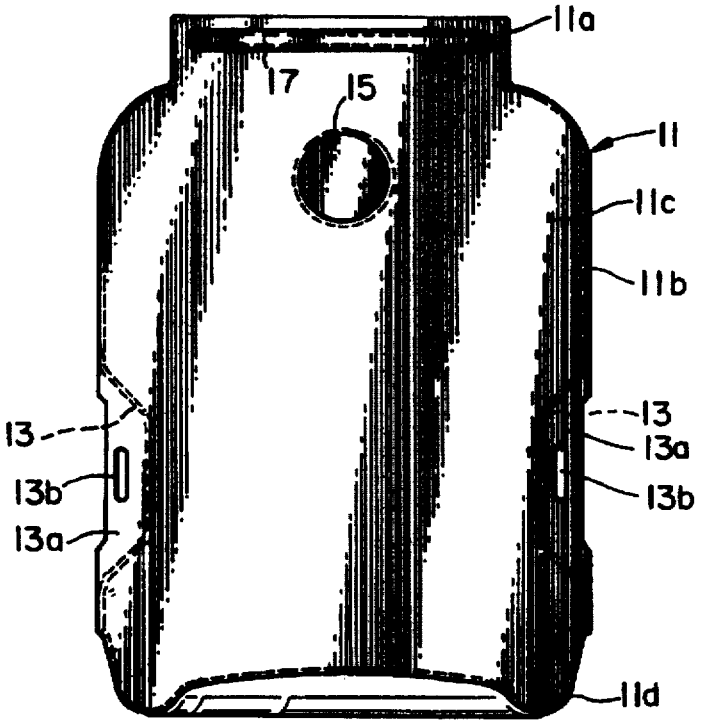
FIG. 5 is an elevational view of an individual container portion of the multiple part container taken along the lines 5—5 in FIG. 4.
Figure 6:
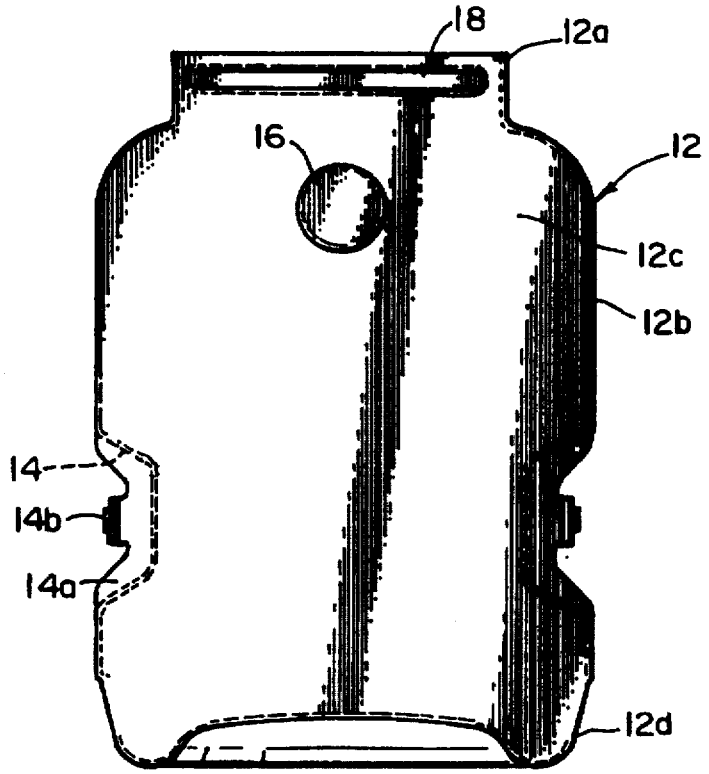
FIG. 6 is a fractional view of another individual container portion of the multiple part container taken along the lines 6—6 in FIG. 4.
Figure 8:
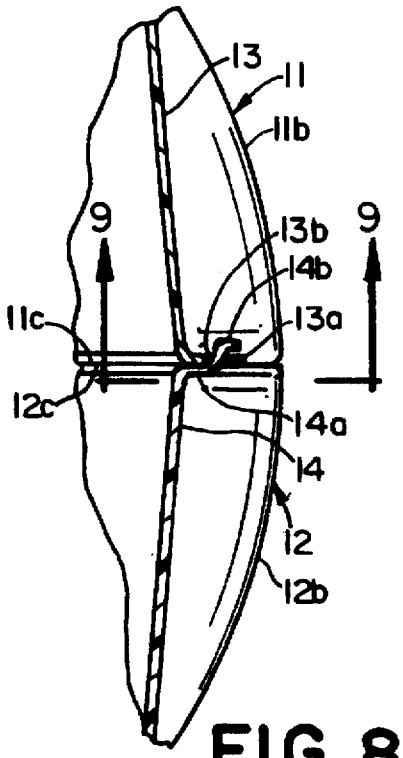
FIG. 8 is an enlarged sectional view taken along the lines 8—8 in FIG. 3
Figure 9:
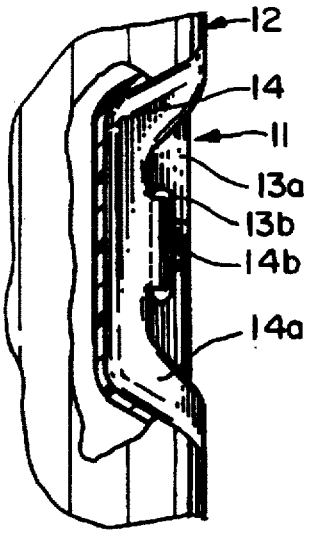
FIG. 9 is an enlarged sectional view taken along the lines 9—9 in FIG. 8.

To lock the individual containers 11 and 12 together, each of these containers are provided with locking structure integral with the sidewalls of each individual container for locking together the individual containers forming the fractional portions about the central longitudinal axis to form a unitary multiple part container. Each of the individual containers 11 and 12 is provided with spaced depressions 13 and 14 in the respective cylindrical walls **11*b* and 12*b* and having locking structure for locking the two containers 11 and 12 together. This is best shown in FIGS. 1, 3, 8 and 9. As will be seen from the drawings there is a pair of depressions 13 and 14 on the opposite sides of the multi-part container 10. The depressions 13 and 14 mate with each other as best seen in FIGS. 1 and 8. The depression 13 in the semi-cylindrical wall 11*b* ends in a web 13*a* which is aligned with and forms an extension of the flat sidewall 11*c* of the semi-cylindrical container 11. The web 13*a* is also provided with an aperture 13*b*. This structure is best seen in FIGS. 5 and 8. Similarly, the depression 14 in the semi-cylindrical wall 12*b* ends in a web 14*a* which is in line with and forms an extension of the flat sidewall 12*c* of the semi-cylindrical container 12. The web 14*a* is also provided with a latch 14*b* which is in the form of an extension adapted to extend through the aperture 13*b*. This is best seen in FIGS. 8 and 9**.

Figure 7:
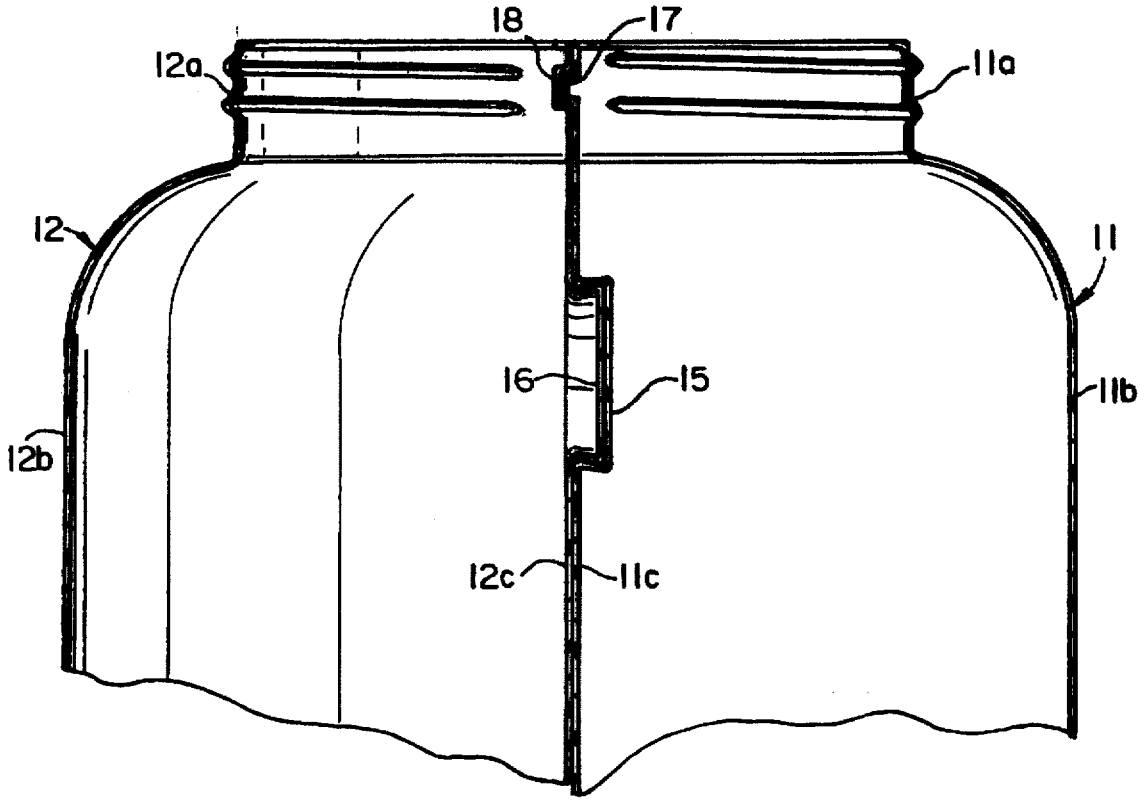
FIG. 7 is an enlarged sectional view taken along the lines 7—7 in FIG. 4.

To assemble the individual containers 11 and 12 into the multiple part container 10 the flat sidewalls **11*c* and 12*c* are placed in abutting relation as shown in FIGS. 1, 4, 7 and 8. When the individual containers 11 and 12 are moved together from the position shown in FIG. 2 to the position shown in FIG. 1, the latching structure 14b on the container 12 is adapted to be inserted in and extend through the mating aperture 13b on the individual container 11. This is best seen in FIGS. 8 and 9. The latch members 14b and the apertures 13b in the web 13a provide the locking structure for locking the two individual containers 11 and 12 together. In order to prevent the upper portions of the individual containers 11 and 12 from twisting with respect to each other, the flat wall 11c of container 11 is provided with a female recess 15 which is adapted to receive the male projection or button 16 which is formed in the flat sidewall 12c of container 12. This arrangement is best seen in FIG. 7. To further prevent the upper ends of the individual containers 11 and 12 from twisting with respect to each other when assembled, the upper end of the flat wall 11c of container 11 is provided with a rib 17 which is adapted to be received in a mating recess 18 molded into the flat sidewall 12c of container 12. Thus the mating button members 15 and 16 and the mating rib and groove members 17 and 18 supplement the locking structure carried by the webs 13a and 14a as described above. The open mouths 11a and 12a of the containers 11 and 12 are preferably provided with screw threads which cooperate with a screw lid 19, FIGS. 1 and 2, to aid in holding the individual containers 11 and 12 together about the central axis of the multiple part container 10** during shipment.

As pointed out above, a multiple part container of the type disclosed herein is particularly adapted for packaging of chemical products such as a solid detergent composition of the type disclosed in the aforesaid U.S. Pat. No. 5,318,713. Containers of this type are preferably made of a material which is capable of withstanding a highly alkaline cast detergent and the elevated temperatures which may exist during the production of the cast detergent in the individual containers and during a washing operation. The lid 19 is preferably made from the same material as the individual containers 11 and 12 making up the multiple part container 10. A preferred material is a thermoplastic material which is easily molded into any configuration and particularly one which has adequate strength and flexibility for providing the locking structure 13b and 14b as described above. Examples of suitable thermoplastic materials include polyethylene, polypropylene, polystyrene and polyvinylchloride with suitable filler materials. All of such materials have the characteristic of being moldable or injectable during formation of the container.

Since the multiple part container 10 is made up of a plurality of individual containers, the individual containers can be filled separately and thus avoid any contamination problems during the filling operation. After the individual containers such as containers 11 and 12 have been filled, they are then assembled together with the locking structure locking the individual containers securely to each other. The cover is then placed on the open top of the container and the completed multiple part container 10 is ready for shipment. The multiple part container 10 may be made of any dimensions so as to fit any of a wide variety of dispensing systems already used in commerce. It will be noted that the locking structure for the multiple part container is disposed within the periphery or circumference of the multiple part container 10. The purpose of this is to permit the multiple part container to be inserted into a commercial dispensing system of predetermined diameter corresponding to the diameter of the multiple part container.

While there has been described and illustrated a preferred embodiment of the invention, it will be understood that further modifications may be made without departing from the spirit and scope of the invention as set forth in the appended claims.

What is claimed is:

1. A multiple part container having a central longitudinal axis and a rounded cross section, said multiple part container comprising:

a plurality of individual separable containers each having a mouth, a flat sidewall, a curved sidewall and a closed bottom to form fractional portions of said multiple part container, a depression on each side of the curved sidewall of each individual container, said depressions in each curved sidewall extending inwardly toward said central longitudinal axis and mating with a depression in the adjacent fractional portion of the multiple part container, and locking structure integral with and extending outwardly from said mating depressions of each individual container for locking together said individual containers forming said fractional portions about said central longitudinal axis to form a unitary multiple part container.

2. A multiple part container according to claim 1 wherein said locking structure comprises cooperating male and female elements on said individual containers located within the periphery of the multiple part container.

3. A multiple part container according to claim 2 wherein said locking structure includes interlocking button structure on said flat sidewall of each individual container.

4. A multiple part container according to claim 1 including a common top for covering all of the mouths of said individual containers.

5. A multiple part container according to claim 4 wherein said container is cylindrical and said common top comprises a screw lid for said multiple part cylindrical container and said mouths of said individual containers are associated with screw threads for cooperation with said screw lid to aid in holding said fractional portions together about said central longitudinal axis.

6. A thermoplastic multiple part container according to claim 1.

7. A multiple part plastic container having a central longitudinal axis and a rounded cross section, said multiple part container comprising a plurality of individual separable containers, each having a mouth, a curved sidewall, a flat sidewall and a closed bottom to form fractional portions of said multiple part container, each curved sidewall of each individual container having a pair of spaced depressions, one depression in each pair being located on opposite sides of the curved sidewall in each individual container, said depressions in each curved sidewall extending inwardly toward said central longitudinal axis and mating with a depression in the adjacent fractional portion of the multiple part container, and locking structure integral with and extending outwardly from said mating depressions on said curved sidewall of each individual container for locking together said individual containers forming said fractional portions about said central longitudinal axis to form a unitary multiple part container.

8. A multiple part container according to claim 7 wherein said locking structure comprises a web aligned with and forming an extension of said flat sidewall of each individual container.

9. A multiple part container according to claim 8 wherein said locking structure comprises cooperating male and female elements on said web of said individual containers located within the periphery of the multiple part container.

10. A multiple part container according to claim 7 including interlocking button structure on the engaging flat sidewalls of said individual containers.

11. A multiple part container according to claim 7 including mating rib and recess structure on the engaging flat sidewalls of said individual containers.

12. A multiple part container according to claim 7 including a common top for covering all of the mouths of said individual containers.

13. A substantially cylindrical multiple part container having a central longitudinal axis, said multiple part container having a plurality of individual separable containers arranged about said central longitudinal axis, each having a mouth, a flat sidewall, a curved sidewall and a closed bottom to form fractional portions of said substantially cylindrical multiple part container, a depreision on each side of the curved sidewall of each individual container, said depressions in each curved sidewall extending inwardly toward said central longitudinal axis and mating with a depression in the adjacent fractional portion of the substantially cylindrical multiple part container, said depressions in each curved sidewall having their ends joined by a web which is aligned with and forms an extension of the flat sidewall of each individual container, one web on each individual container having a male latching element and one web on each individual container having a female latching element for receiving the male latching element on the web of the adjacent individual container for locking together said individual containers forming said fractional portions about said central longitudinal axis to form a unitary substantially cylindrical multiple part container.

14. A substantially cylindrical multiple part container according to claim 13 wherein said webs and said latching elements are disposed within said depressions in said curved sidewalls and within the periphery of said cylindrical multiple part container.

15. A substantially cylindrical multiple part container according to claim 14 wherein said latching elements are disposed on and accessible from the exterior of said cylindrical multiple part container.

16. A substantially cylindrical multiple part container according to claim 13 wherein said mouths of each individual separable container form a segment of a circle and are arranged about said central longitudinal axis, and a common cover for all of the mouths of said individual separable containers.

17. A thermoplastic multiple part container according to claim 13.

* * * * *